US008567322B2

(12) United States Patent
Trimble et al.

(10) Patent No.: US 8,567,322 B2
(45) Date of Patent: Oct. 29, 2013

(54) TABLE WITH TABLETOP CORNER SUPPORT

(75) Inventors: Joshua A. Trimble, Franklin, IN (US); Larry Voris, Nashville, IN (US)

(73) Assignee: Cosco Management, Inc., Wilmington, DE (US)

( * ) Notice: Subject to any disclaimer, the term of this patent is extended or adjusted under 35 U.S.C. 154(b) by 258 days.

(21) Appl. No.: 12/985,116

(22) Filed: Jan. 5, 2011

(65) Prior Publication Data

US 2011/0253015 A1 Oct. 20, 2011

Related U.S. Application Data

(60) Provisional application No. 61/325,693, filed on Apr. 19, 2010.

(51) Int. Cl.
*A47B 3/00* (2006.01)

(52) U.S. Cl.
USPC ..... 108/27; 108/901; 108/126

(58) Field of Classification Search
USPC ..... 108/27, 161, 125–127, 50.11, 129, 130, 108/133, 901; 248/345.1
See application file for complete search history.

(56) References Cited

U.S. PATENT DOCUMENTS

| | | | | | |
|---|---|---|---|---|---|
| 4,731,918 | A * | 3/1988 | Burghardt | 29/525.12 |
| 5,947,037 | A * | 9/1999 | Hornberger et al. | 108/115 |
| 5,983,807 | A * | 11/1999 | Tarnay et al. | 108/132 |
| 6,371,034 | B1 * | 4/2002 | Simpson et al. | 108/129 |
| 6,651,568 | B1 * | 11/2003 | Buono | 108/127 |
| 6,823,806 | B1 * | 11/2004 | Buono | 108/132 |
| 7,059,255 | B2 * | 6/2006 | Tsai | 108/129 |
| 7,299,753 | B2 * | 11/2007 | Strong | 108/115 |
| 7,428,872 | B2 * | 9/2008 | Strong et al. | 108/132 |
| 7,472,655 | B2 * | 1/2009 | Leng | 108/27 |
| 8,091,489 | B2 * | 1/2012 | Karrasch et al. | 108/153.1 |
| 2002/0092445 | A1 * | 7/2002 | Glover et al. | 108/129 |
| 2006/0130716 | A1 * | 6/2006 | Ashby et al. | 108/125 |
| 2008/0078310 | A1 * | 4/2008 | VanNimwegen et al. | 108/127 |
| 2008/0202390 | A1 * | 8/2008 | Branch et al. | 108/35 |
| 2009/0056593 | A1 * | 3/2009 | Farber et al. | 108/12 |
| 2011/0100270 | A1 * | 5/2011 | Atkins | 108/127 |

* cited by examiner

*Primary Examiner* — Janet M Wilkens
(74) *Attorney, Agent, or Firm* — Barnes & Thornburg LLP

(57) ABSTRACT

A table includes a tabletop and legs for the tabletop. The tabletop includes a blow-molded structure and components coupled to the blow-molded structure to rigidify the tabletop.

24 Claims, 6 Drawing Sheets

TABLE WITH TABLETOP CORNER SUPPORT

PRIORITY CLAIM

This application claims priority under 35 U.S.C. §119(e) to U.S. Provisional Application Ser. No. 61,325,693, filed Apr. 19, 2010, which is expressly incorporated by reference herein.

BACKGROUND

The present disclosure relates to a table, and particularly to a table with a blow-molded tabletop. More particularly, the present disclosure relates to a corner support for a tabletop.

SUMMARY

A table in accordance with the present disclosure includes a tabletop and legs for elevating the tabletop above the ground. The tabletop includes a blow-molded structure and a frame made of metal and coupled to an underside of the blow-molded structure.

In illustrative embodiments, a corner-reinforcement unit is molded using a plastics material and is a component separate from the blow-molded structure. A separate corner-reinforcement unit is mounted on each corner of the tabletop to rigidify the corner. In illustrative embodiments, each corner-reinforcement unit is coupled to one or both of the blow-molded structure and frame to retain that unit in an anchored position on the corner of the tabletop.

In illustrative embodiments, each corner-reinforcement unit is retained in a stationary position in a socket formed in the underside of the blow-molded structure at one of the outer corners of the blow-molded structure. The socket is formed to lie below the top surface of the tabletop and inside an outer side wall of the tabletop so that the corner-reinforcement unit retained therein is not visible to a user looking down at the tabletop rigidified by the corner-reinforcement units.

In illustrative embodiments, each corner-reinforcement unit is a monolithic component molded of a plastics material and configured to include a rigidifier and a frame mount. The rigidifier comprises an endless perimeter band and a series of stiffener beams coupled to inwardly facing surfaces of the perimeter band and arranged to extend across an interior region of the rigidifier bounded by the perimeter band. The frame mount is coupled to the perimeter band and mated to a frame included in the tabletop and mounted to the underside of the blow-molded structure so that the corner-reinforcement unit is retained in a stationary position in the companion socket formed in the blow-molded structure.

In illustrative embodiments, a corner-reinforcement unit is retained in a stationary position in each of four outer corners included in a rectangular tabletop. In one embodiment, the tabletop is included in a centerfold table including separate blow-molded first and second platforms coupled to one another by a center hinge and each platform carries two corner-reinforcement units. In other embodiments, the tabletop includes a monolithic blow-molded structure carrying, for example, four corner-reinforcement units.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
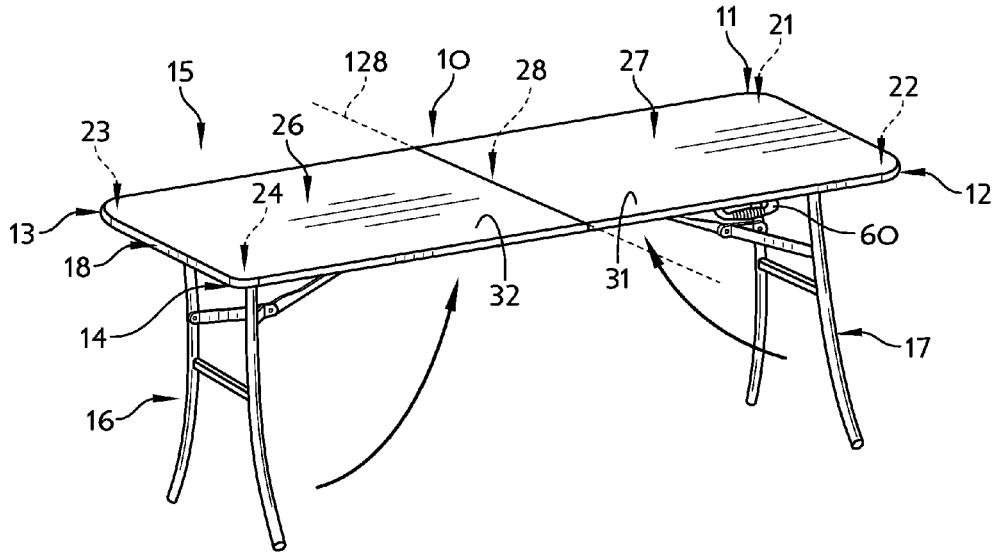
FIG. 1 is a perspective view of a center-folding table showing a tabletop and leg units supporting opposite end portions of the tabletop.

A tabletop 10 having four corners 11-14 is included in a table 15 as suggested in FIG. 1. Tabletop 10 is supported by left-side and right-side leg units 16, 17 also included in table 15 as suggested in FIG. 1. Tabletop 10 includes a blow-molded counter 18, a frame 19 coupled to the underside of blow-molded counter 18, and a separate corner-reinforcement system 20 configured and arranged to reinforce each of four tabletop corners 11-14, as shown, for example, in FIG. 2. In illustrative embodiments, corner-reinforcement system 20 comprises units 21-24 that are manufactured separately and then retained in place on blow-molded counter 18 in companion interior unit-receiving sockets 121-124 formed in table top corners 11-14 using fasteners anchored to units 21-24 and to one or both of blow-molded counter 18 and frame 19.

In the embodiment illustrated in FIGS. 1-7, blow-molded counter 18 includes a blow-molded first platform 31 carrying first and second corner-reinforcement units 21, 22 and a blow-molded second platform 32 carrying third and fourth corner-reinforcement units 23, 24. Blow-molded counter 18 also includes a hinge 28 interconnecting first and second platforms 31, 32. In the embodiment illustrated in FIG. 8, tabletop 110 in a table 115 includes a monolithic blow-molded counter 118 comprising interconnected, blow-molded first and second platforms 31, 32 and carrying all four corner-reinforcement units 21-24.

In an illustrative embodiment, corner-reinforcement system 20 includes a first corner-reinforcement unit 21 mating with blow-molded counter 18 at a first outer corner 11 of tabletop 10 as suggested in FIGS. 2, 5, 6, and 7. An illustrative first corner-reinforcement unit 21 is shown in detail in FIG. 3. Corner-reinforcement system 20 also includes a second corner-reinforcement unit 22 mating with blow-molded counter 18 at a second outer corner 12 of tabletop 10, a third corner-reinforcement unit 23 mating with blow-molded counter 18 at a third outer corner 13 of tabletop 10, and a fourth corner-reinforcement unit 24 mating with blow-molded counter 18 at a fourth outer corner 14 of tabletop 10 as shown, for example, in FIG. 2.

In an illustrative embodiment, table 15 is a center-folding table and left-side and right-side leg units 16, 17 are movable relative to blow-molded counter 18 at the option of a user from the extended, use positions shown in FIG. 1 to collapsed, storage positions (not shown) along the underside of tabletop 10. Once left-side and right-side leg units 16, 17 are stored in their collapsed, storage positions, left and right top portions 26, 27 of tabletop 10 are folded toward one another about a pivot axis 128 established by a hinge 28 (shown, for example, in FIG. 2) interconnecting left and right top portions 26, 27.

Figure 2:
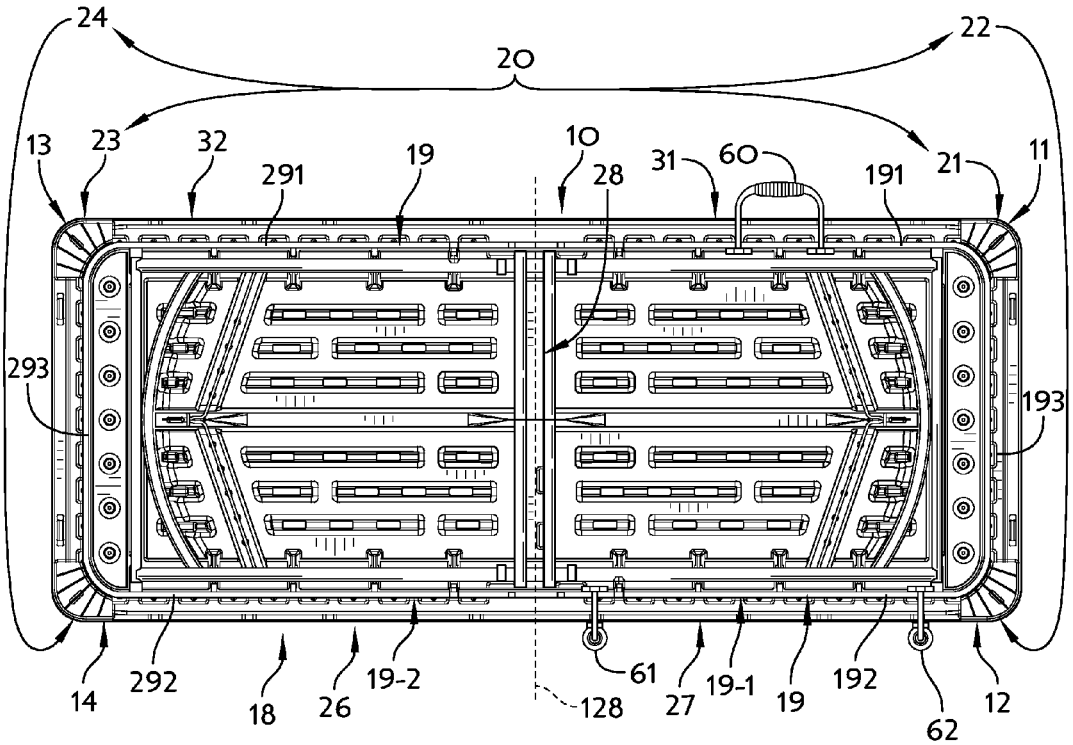
FIG. 2 is a plan view of the underside of the tabletop of FIG. 1 (before installation of the leg units) showing that the tabletop includes a right top portion comprising a blow-molded first platform, a first corner-reinforcement unit coupled to an outer first corner of the blow-molded first platform, a second corner-reinforcement unit coupled to an outer second corner of the blow-molded first platform, a carry handle coupled to a first side of the first platform, and two wheel units coupled to a second side of the first platform and showing that the tabletop also includes a left top portion comprising a blow-molded second platform, a third corner-reinforcement unit coupled to an outer first corner of the blow-molded second platform, and a fourth corner-reinforcement unit coupled to an outer second corner of the blow-molded second platform.
Figure 5:
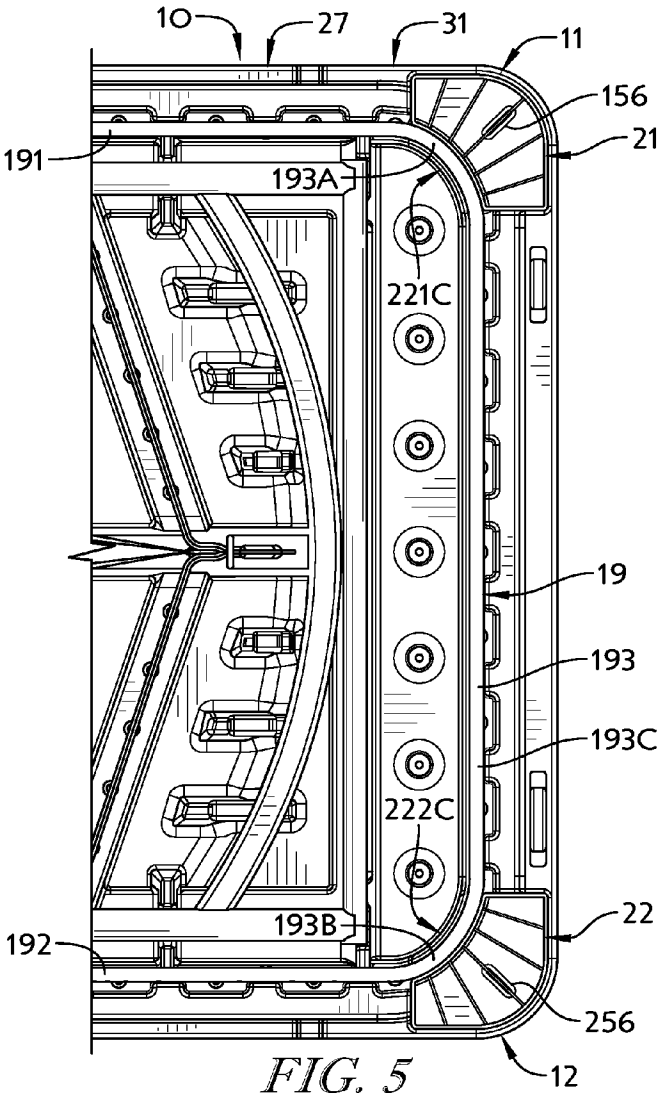
FIG. 5 is a view similar to FIG. 4 after (1) the first corner-reinforcement unit has been mounted in a first of the interior unit-receiving sockets to rigidify the outer first corner of the blow-molded first platform; (2) the second corner-reinforcement unit has been mounted in a second of the interior unit-receiving sockets to rigidify the outer second corner of the blow-molded first platform; and (3) a U-shaped first frame segment has been mounted on the underside of the blow-molded first platform to cause a first curved section in the U-shaped first frame segment to mate with the first corner-reinforcement unit and to cause a second curved section in the U-shaped first frame segment to mate with the second corner-reinforcement unit.
Figure 4:
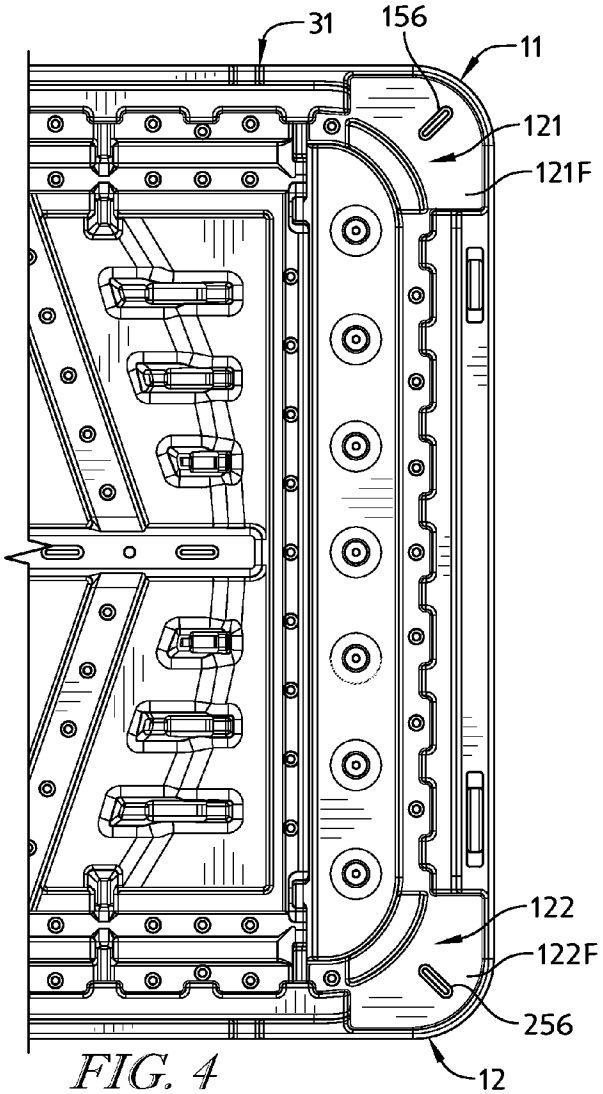
FIG. 4 is an enlarged portion of the plan view of the blow-molded first platform included in the right top portion of the tabletop before the first and second corner-reinforcement units, carry handle, and wheel units are coupled to the blow-molded first platform and showing that an interior unit-receiving socket sized to receive one of the corner-reinforcement units is formed in each of the outer first and second corners of the blow-molded first platform and that a diagonally extending tab-receiving slot is formed in the floor of each of the unit-receiving sockets.

Right top portion 27 of tabletop 10 includes a blow-molded first platform 31 and separate first and second corner-reinforcement units 21, 22 as suggested in FIGS. 2 and 5. First corner-reinforcement unit 21 is coupled to a first outer corner 11 of tabletop 10 defined by a first outer corner of blow-molded first platform 31 as suggested in FIG. 2. Second corner-reinforcement unit 22 is coupled to a second outer corner 12 of tabletop 10 defined by a second outer corner of blow-molded first platform 31 as also suggested in FIG. 2.

Left top portion 26 of tabletop 10 includes a blow-molded second platform 32 and separate third and fourth corner-reinforcement units 23, 24 as suggested in FIG. 2. Third corner-reinforcement unit 23 is coupled to a third outer corner 13 of tabletop 10 defined by a first outer corner of blow-molded second platform 32 as suggested in FIG. 2. Fourth corner-reinforcement unit 24 is coupled to a fourth corner 14 of tabletop 10 defined by a second outer corner of blow-molded second platform 32 as also suggested in FIG. 2.

In illustrative embodiments, blow-molded counter 18 comprises blow-molded first platform 31 of right top portion 27, blow-molded second platform 32 of left top portion 26, and hinge 28 as suggested in FIGS. 1 and 2. First and second corner-reinforcement units 21, 22 reinforce corners 11, 12, respectively, of blow-molded first platform 31 in blow-molded counter 18 as suggested in FIGS. 1, 2, and 5. Third and fourth corner-reinforcement units 23, 24 reinforce corners 13, 14, respectively, of blow-molded second platform 32 in blow-molded counter 18 as suggested in FIGS. 1 and 2.

In an illustrative embodiment shown in FIG. 2, frame 19 includes a U-shaped first frame segment 19-1 coupled to the underside of blow-molded first platform 31 and arranged to mate with each of the separate first and second corner-reinforcement units 21, 22. As suggested in FIGS. 2 and 5, U-shaped first frame segment 19-1 includes a first side rail 191, a second side rail 192 arranged to lie in spaced-apart parallel relation to first rail 191, and an end rail 193 arranged to interconnect first and second side rails 191, 192. Similarly, frame 19 includes a U-shaped second frame segment 19-2 coupled to the underside of blow-molded second platform 32 and arranged to mate with each of the separate third and fourth corner-reinforcement units 23, 24 as suggested in FIG. 2. As suggested in FIG. 2, U-shaped second frame segment 19-2 includes a first side rail 291, a second side rail 292 arranged to lie in spaced-apart parallel relation to first rail 291, and an end rail 293 arranged to interconnect first and second side rails 291, 292. In an illustrative embodiment, frame 19 is made of a metal material, but it is within the scope of this disclosure to use any suitable rigid material.

In illustrative embodiments, as suggested in FIGS. 2 and 5, end rail 193 of U-shaped first frame segment 19-1 includes a first curved section 193A coupled to first side rail 191 and to first corner-reinforcement unit 21, a second curved section 193B coupled to second side rail 192 and to second corner-reinforcement unit 22, and a straight section 193C arranged to interconnect first and second curved sections 193A, 193B. As suggested in FIG. 2, end rail 293 of U-shaped second frame segment 19-2 has a shape similar to end rail 193 and is coupled to third and fourth corner-reinforcement units 23, 24.

Figure 3:
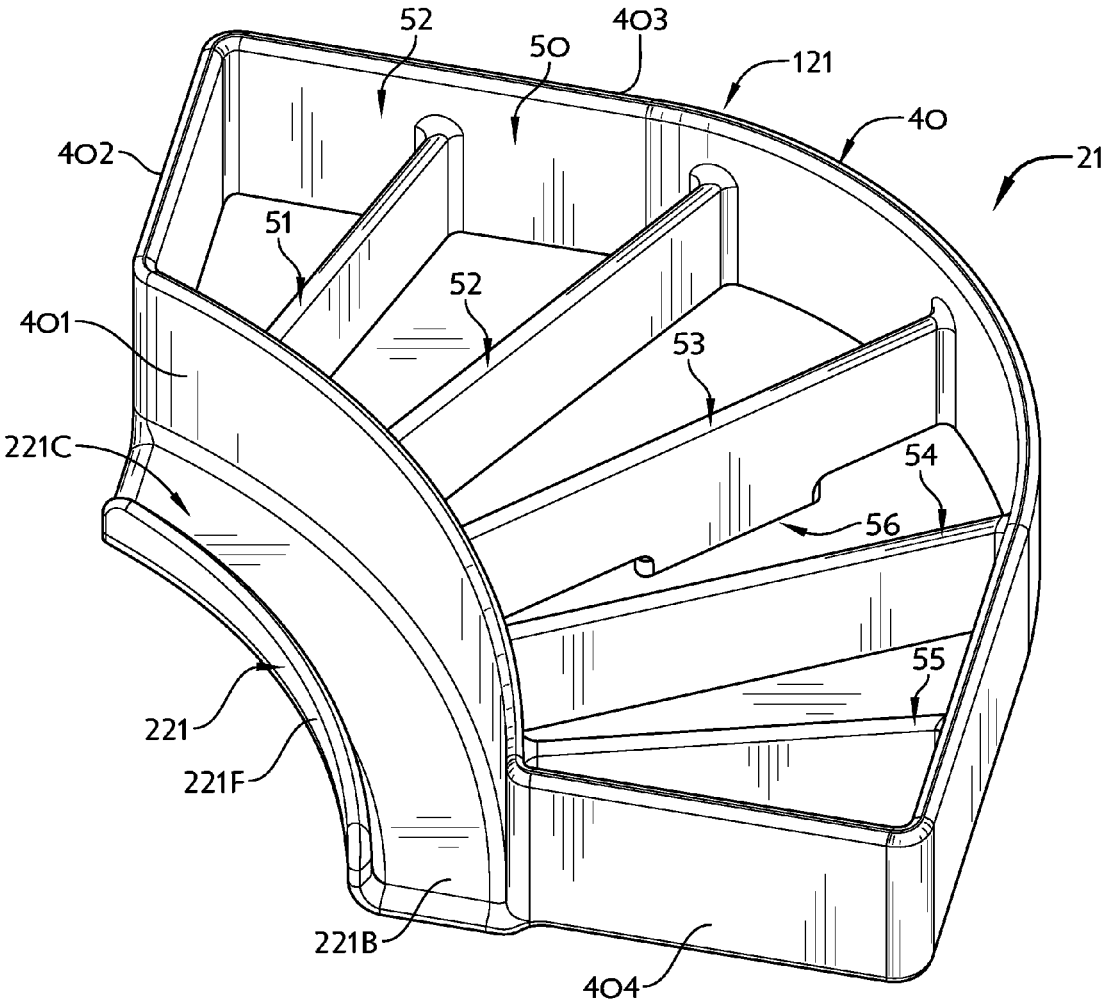
FIG. 3 is an enlarged perspective view of the first corner-reinforcement unit of FIG. 2 before it is coupled to the outer first corner of the blow-molded first platform shown in FIG. 4.

First corner-reinforcement unit 21 includes a rigidifier 121 and a frame mount 221 coupled to rigidifier 121 as shown, for example, in FIG. 3. In an illustrative embodiment, each of second, third, and fourth corner-reinforcement units 22, 23, and 24 has a substantially identical shape. Rigidifier 121 of first corner-reinforcement unit 21 is configured to provide means separate from blow-molded first platform 31 for rigidifying a first outer corner 11 of blow-molded first platform 31 (and tabletop 10). Frame mount 221 is configured to mate with U-shaped first frame segment 19-1 as suggested in FIGS. 6 and 7.

Rigidifier 121 includes a perimeter band 40 and a series of stiffener beams 51-55 arranged to lie in spaced-apart fan-shaped relation to one another and coupled to inwardly facing surfaces of perimeter band 40 as shown, for example, in FIG. 3. Perimeter band 40 is endless in an illustrative embodiment. Rigidifier 121 also includes a downwardly extending anchor tab 56 appended to a third beam 53 as suggested in FIG. 3.

Perimeter band 40 includes, in series, a first curved band section 401, a first straight band section 402, a second curved band section 403, and a second straight band section 404 as shown, for example, in FIG. 3. Band sections 401-404 cooperate to define an interior region 50 containing stiffener beams 51-55 as suggested in FIG. 3. First curved band section 401 is coupled to frame mount 221 as suggested in FIG. 3 and has a curved portion that is characterized by a relatively larger first radius of curvature as suggested in FIG. 5. Second curved band section 403 is characterized by a relatively smaller second radius of curvature as suggested in FIG. 5.

Frame mount 221 includes a curved flange 221F and a curved base 221B as shown, for example, in FIG. 3. Curved base 221B is arranged to interconnect a lower edge of each of curved flange 221F and first curved band section 401 to form channel means 221C therebetween for receiving a portion (e.g., first curved section 193A of end rail 193) of U-shaped first frame segment 19-1 of frame 19 therein as suggested in FIGS. 2 and 5-7. In an illustrative embodiment, curved flange 221F has a radius of curvature that is about equal to the radius of curvature of first curved band section 401 as suggested in FIG. 5.

First corner-reinforcement unit 21 is mounted in a companion first interior unit-receiving socket 121 formed in blow-molded first platform 31 as suggested in FIGS. 4-7. First interior unit-receiving socket 121 is empty in FIG. 4.

Figure 6:
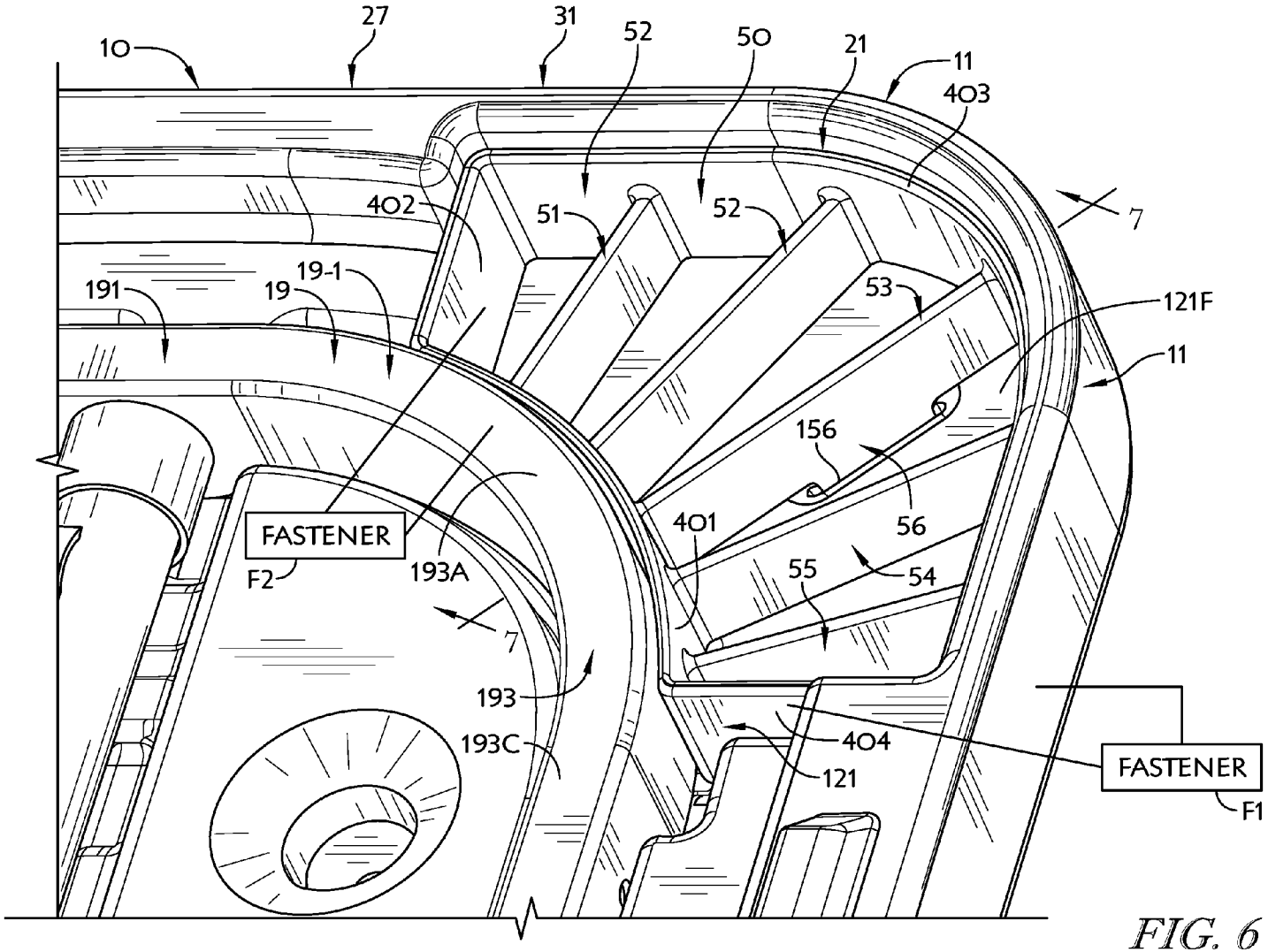
FIG. 6 is an enlarged perspective view of the first corner-reinforcement unit mounted in the companion interior unit-receiving socket formed in the outer first corner of the blow-molded first platform showing placement of a downwardly extending anchor tab included in the first corner-reinforcement unit into the companion diagonally extending tab-receiving slot formed in the floor of that unit-receiving socket.
Figure 7:
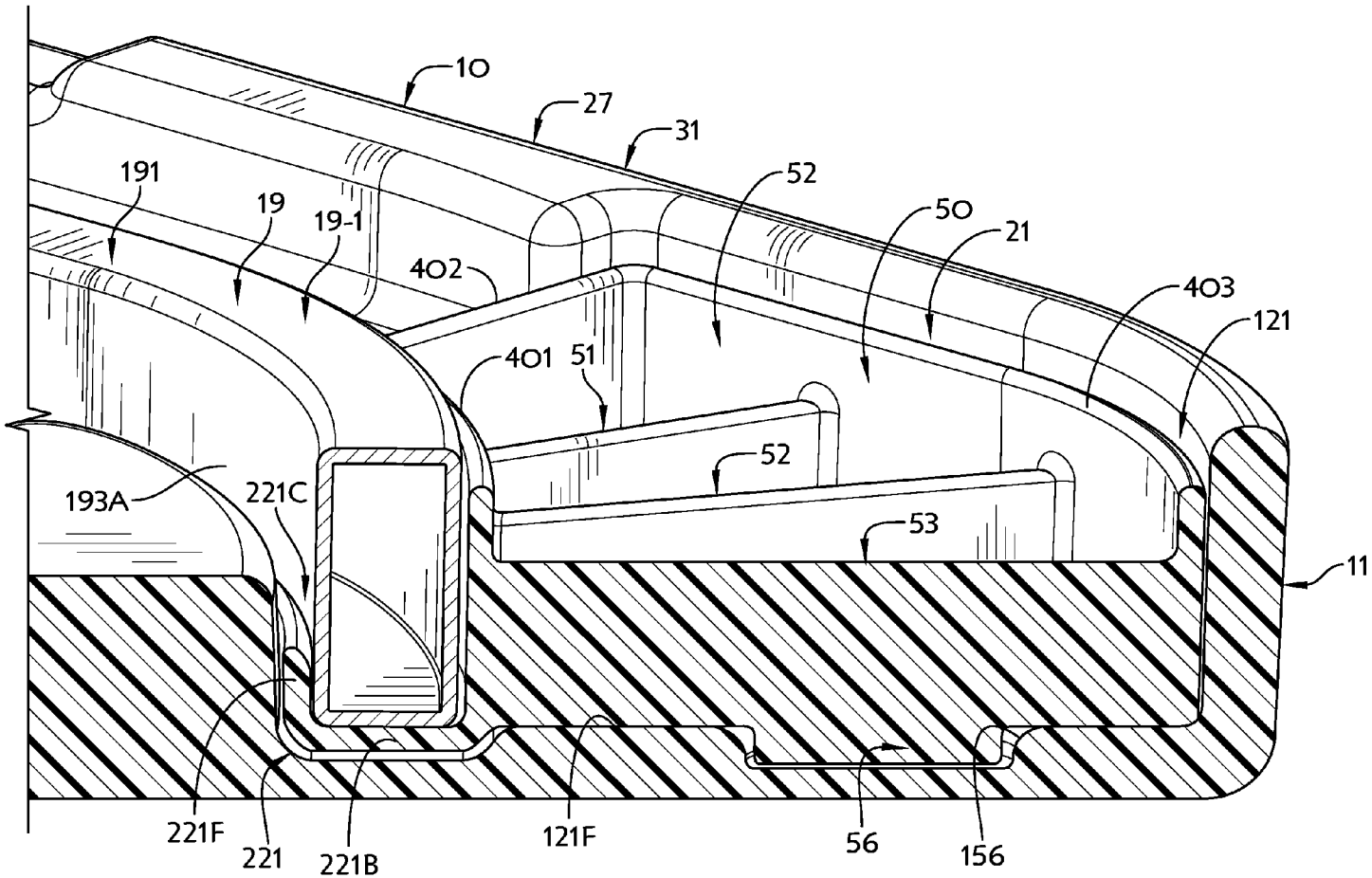
FIG. 7 is an enlarged sectional view taken along line 7-7 of FIG. 6.
Figure 8:
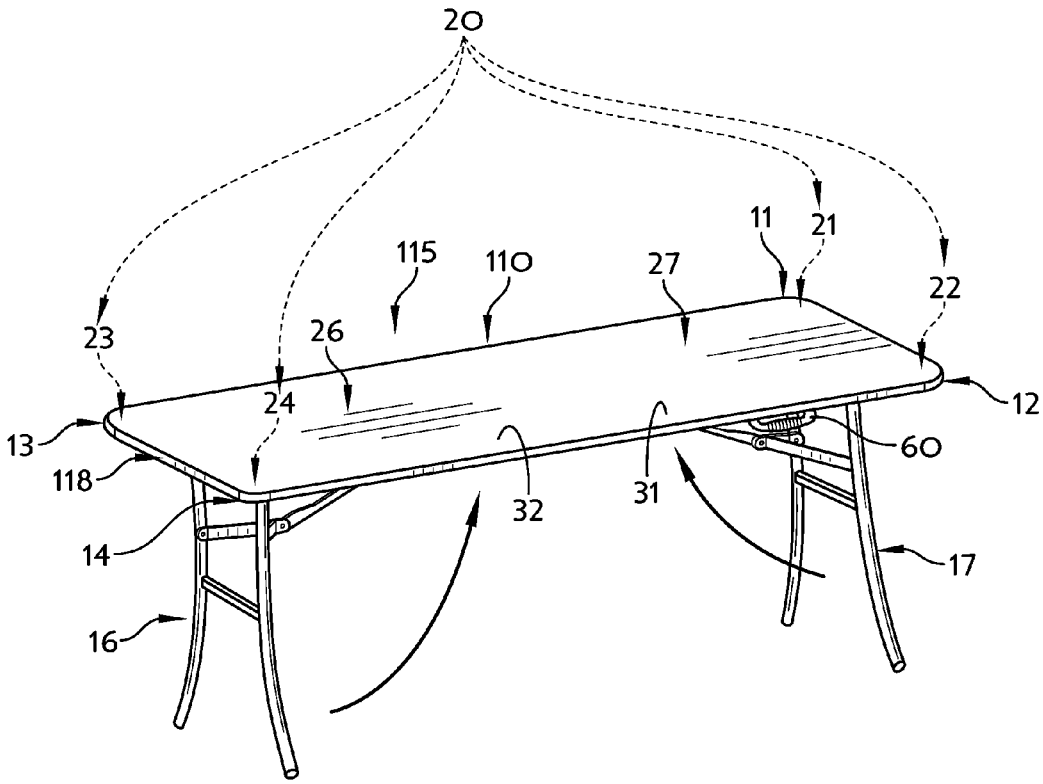
FIG. 8 is a perspective view of another table in accordance with the present disclosure showing a tabletop and leg units supporting opposite end portions of the tabletop and showing that the tabletop includes a monolithic countertop comprising a blow-molded first platform and a blow-molded second platform.

During assembly of components to form tabletop 10, first corner-reinforcement unit 21 is placed in socket 121 as suggested in FIG. 5 illustratively to cause downwardly extending anchor tab 56 (appended to third stiffener beam 53) to extend into a companion diagonally extending tab-receiving slot 156 formed in a floor 121F of socket 121 as suggested in FIGS. 6 and 7. Thereafter, first curved section 193A of end rail 193 of U-shaped first frame segment 19-1 is placed into channel means 221C formed in first corner-reinforcement unit 21 and first frame segment 19-1 is retained in place on blow-molded first platform 31. It is within the scope of this disclosure, as suggested diagrammatically in FIG. 6, to use any suitable fastener F1 to anchor first corner-reinforcement unit 21 to blow-molded first platform 31 and/or any suitable fastener F2 to anchor first corner-reinforcement unit 21 to first frame segment 19-1 (e.g., first curved frame section 193A) so that first corner-reinforcement unit 21 is retained in place on blow-molded first platform 31 at first outer corner 11.

Second corner-reinforcement unit 22 is mounted in a companion second interior unit-receiving socket 122 formed in blow-molded second platform 32 as suggested in FIGS. 4-7. Second interior unit-receiving socket 122 is empty in FIG. 4.

During assembly of components to form tabletop 10, second corner-reinforcement unit 22 is placed in socket 122 illustratively to cause downwardly extending anchor tab 56 to extend into a companion diagonally extending tab-receiving slot 256 formed in a floor 122F of socket 122 as suggested in FIG. 5. Thereafter, second curved section 193B of end rail 193 of U-shaped first frame segment 19-1 is placed into channel means 222C formed in second corner-reinforcement unit 22 and first frame segment 19-1 is retained in place on blow-molded first platform 31. It is within the scope of this disclosure to use any suitable fastener to anchor second corner-reinforcement unit 22 to blow-molded first platform 31 and/or any suitable fastener to anchor second corner-reinforcement unit 22 to first frame segment 19-1 (e.g., second curved frame section 193B) so that second corner-reinforcement unit 22 is retained in place on blow-molded first platform 31 at second outer corner 12.

In an illustrative embodiment shown in FIG. 2, right top portion 27 of tabletop 10 also includes a carry handle 60 and first and second wheel units 61, 62. Carry handle 60 is coupled to first side rail 192 of U-shaped first frame segment 19-1. First and second wheel units 61, 62 are arranged to lie in spaced-apart relation to one another and are coupled to second side rail 192 of U-shaped first frame segment 19-1.

In illustrative embodiments, each of corner-reinforcement units 21-24 is made of a plastics material and frame 19 is made of a metal material such as steel or aluminum. Each unit 21-24 is an injection-molded part separate from each of blow-molded (HDPE) platforms 31, 32. Such a feature facilitates construction of a blow-molded table provided with custom-designed corner-reinforcement units configured to meet any applicable corner-sturdiness requirement and use more or less plastics material to meet applicable manufacturing cost budgets. Units 21-24 are molded separately from rest of tabletop 10 and then sandwiched between blow-molded platforms 31, 32 and portions of frame 19.

The invention claimed is:

1. A table comprising:

a tabletop including a first corner-reinforcement unit and a blow-molded first platform having a first outer corner formed to include a first interior unit-receiving socket;

a tabletop support coupled to the tabletop and configured to elevate the tabletop above ground underlying the tabletop, wherein the first corner-reinforcement unit is molded using a plastics material and is a component separate from the blow-molded first platform, the first corner-reinforcement unit is retained in a stationary position on an underside of the blow-molded first platform at the first outer corner in the first interior unit-receiving socket formed in the blow-molded first platform at the first outer corner to rigidify the first outer corner of the blow-molded first platform;

wherein the first corner-reinforcement unit includes a rigidifier configured to provide means separate from the blow-molded first platform for rigidifying the first outer corner of the blow-molded first platform and the rigidifier includes a perimeter band and a series of stiffener beams coupled to inwardly facing surfaces of the perimeter band to extend across an interior region of the rigidifier bounded by the perimeter band; and wherein the tabletop further includes a frame coupled to the underside of the blow-molded first platform and the first corner-reinforcement unit further includes a frame mount coupled to the perimeter band and configured to mate with the frame to locate the frame alongside the rigidifier.

2. The table of claim 1, wherein the frame includes a first curved section, the perimeter band includes a first curved band section coupled to the stiffener beams and arranged to lie between the first curved section and the stiffener beams, the frame mount includes a curved flange and a curved base, and the curved base is arranged to interconnect a lower edge of each of the curved flange and the first curved band section to form channel means therebetween for receiving the first curved section of the frame therein.

3. The table of claim 2, wherein the tabletop further includes fasteners coupled to the rigidifier and to the first curved section of the frame.

4. The table of claim 2, wherein the tabletop further includes fasteners coupled to the frame mount and to the first curved section of the frame.

5. The table of claim 2, wherein the perimeter band includes, in series, the first curved band section, a first straight band section, a second curved band section, and a second straight band section, and the stiffener bands are arranged to extend between and interconnect the first and second curved bands.

6. A table comprising:

a tabletop including a first corner-reinforcement unit and a blow-molded first platform having a first outer corner formed to include a first interior unit-receiving socket;

a tabletop support coupled to the tabletop and configured to elevate the tabletop above ground underlying the tabletop, wherein the first corner-reinforcement unit is molded using a plastics material and is a component separate from the blow-molded first platform, the first corner-reinforcement unit is retained in a stationary position on an underside of the blow-molded first platform at the first outer corner in the first interior unit-receiving socket formed in the blow-molded first platform at the first outer corner to rigidify the first outer corner of the blow-molded first platform;

wherein the first corner-reinforcement unit includes a rigidifier configured to provide means separate from the blow-molded first platform for rigidifying the first outer corner of the blow-molded first platform and the rigidifier includes a perimeter band and a series of stiffener beams coupled to inwardly facing surfaces of the perimeter band to extend across an interior region of the rigidifier bounded by the perimeter band; and wherein the perimeter band includes a first curved band section and a second curved band section and the stiffener bands are arranged to extend between and interconnect the first and second curved band sections.

7. The table of claim 6, wherein the blow-molded first platform includes an exterior rim at the first outer corner and the first curved band section is arranged to lie in spaced-apart relation to the exterior rim to locate the second curved band section therebetween.

8. The table of claim 7, wherein the stiffener beams are arranged to lie in spaced-apart fan-shaped relation to one another.

9. The table of claim 7, wherein the first curved band section has a curved portion that is characterized by a first radius of curvature and the second band section has a curved portion that is characterized by a relatively smaller second radius of curvature.

10. A table comprising:

a tabletop including a first corner-reinforcement unit and a blow-molded first platform having a first outer corner formed to include a first interior unit-receiving socket;

a tabletop support coupled to the tabletop and configured to elevate the tabletop above ground underlying the tabletop, wherein the first corner-reinforcement unit is molded using a plastics material and is a component separate from the blow-molded first platform, the first corner-reinforcement unit is retained in a stationary position on an underside of the blow-molded first platform at the first outer corner in the first interior unit-receiving socket formed in the blow-molded first platform at the first outer corner to rigidify the first outer corner of the blow-molded first platform; and wherein the first corner-reinforcement unit includes a rigidifier separate from the blow-molded first platform and coupled to the first corner of the blow-molded first platform, the tabletop further includes a frame coupled to the underside of the blow-molded first platform, the frame includes a first elbow potion arranged to extend into the first interior unit-receiving socket, the first outer corner of the blow-molded platform includes an exterior rim, and the rigidifier is arranged to lie between the first elbow portion and the exterior rim.

11. The table of claim 10, wherein the first corner-reinforcement unit further includes a frame mount coupled to the first elbow portion and to the rigidifier.

12. The table of claim 10, wherein the first outer corner further includes a first socket floor defining a boundary of the first interior unit-receiving socket, the rigidifier is arranged to engage the first socket floor, and a base included in the frame mount is interposed between the first elbow portion and the first socket floor.

13. The table of claim 12, wherein the first elbow portion includes a first curved section, the frame mount further includes a curved flange arranged to lie in spaced-apart relation to the rigidifier, the base of the frame mount is curved and arranged to interconnect the curved flange and the rigidifier to form a channel therebetween, and the first curved section of the first elbow portion is retained in a stationary position in the channel.

14. The table of claim 13, wherein the base of the frame mount is positioned to lie between the first curved section and the first socket floor.

15. The table of claim 12, wherein the first socket floor is formed to include a tab-receiving slot opening toward the rigidifier and the rigidifier further includes a perimeter band and a series of stiffener beams coupled to inwardly facing surfaces of the perimeter band to extend across an interior region of the rigidifier bounded by the perimeter band and an anchor tab coupled to one of the stiffener beams and arranged to extend into the tab-receiving slot.

16. The table of claim 10, wherein the rigidifier includes a perimeter band and a series of stiffener beams coupled to inwardly facing surfaces of the perimeter band to extend across an interior region of the rigidifier bounded by the perimeter band.

17. The table of claim 16, wherein the perimeter band includes, in series, the first curved band section, a first straight band section, a second curved band section, and a second straight band section, and the stiffener bands are arranged to extend between and interconnect the first and second curved bands, the first curved band section of the perimeter band is arranged to lie alongside the exterior rim, and the second curved band section is arranged to extend along the first elbow portion.

18. A table comprising:

a tabletop including a first corner-reinforcement unit, a second corner-reinforcement unit, and a blow-molded first platform having a first outer corner formed to include a first interior unit-receiving socket and a second outer corner formed to include a second interior unit-receiving socket;

a tabletop support coupled to the tabletop and configured to elevate the tabletop above ground underlying the tabletop, wherein;

the first corner-reinforcement unit is molded using a plastics material and is a component separate from the blow-molded first platform, the first corner-reinforcement unit is retained in a stationary position on an underside of the blow-molded first platform at the first outer corner in the first interior unit-receiving socket formed in the blow-molded first platform at the first outer corner to rigidify the first outer corner of the blow-molded first platform;

the second corner-reinforcement unit is molded using a plastics material and is a component separate from the blow-molded first platform, the second corner-reinforcement unit is retained in a stationary position on an underside of the blow-molded first platform at the second outer corner in the first interior unit-receiving socket formed in the blow-molded first platform at the second outer corner to rigidify the second outer corner of the blow-molded first platform;

wherein the tabletop further includes a third corner-reinforcement unit, a fourth corner-reinforcement unit, and a blow-molded second platform having a third outer corner formed to include a third interior unit-receiving socket and a fourth outer corner formed to include a fourth interior unit-receiving socket; and wherein the tabletop further includes a frame coupled to the underside of the blow-molded first and second platforms and each of the first, second, third, and fourth corner-reinforcement units is coupled to the frame and to a companion one of the blow-molded first and second platforms.

19. The table of claim 18, wherein the frame includes a U-shaped first frame segment coupled to the underside of the blow-molded first platform and to each of the first and second corner-reinforcement units and a U-shaped second frame segment coupled to the underside of the blow-molded second platform and to each of the third and fourth corner-reinforcement units.

20. The table of claim 19, wherein the U-shaped first frame segment includes a first side rail, a second side rail arranged to lie in spaced-apart relation to the first side rail, and an end rail arranged to interconnect the first and second side rails and coupled to the first and second corner-reinforcement units.

21. The table of claim 20, wherein the end rail includes a first curved section coupled to the first side rail and to the first corner-reinforcement unit, a second curved section coupled to the second side rail and to the second corner-reinforcement unit, and a substantially straight section arranged to interconnect the first and second curved sections.

22. The table of claim 21, wherein first corner-reinforcement unit includes a rigidifier configured to provide means separate from the blow-molded first platform for rigidifying the first outer corner of the blow-molded first platform and the rigidifier includes a perimeter band and a series of stiffener beams coupled to inwardly facing surfaces of the perimeter band to extend across an interior region of the rigidifier bounded by the perimeter band, the tabletop further includes a frame coupled to the underside of the blow-molded first platform, and the first corner-reinforcement unit further includes a frame mount coupled to the perimeter band and configured to mate with the frame to locate the frame alongside the rigidifier.

23. The table of claim 19, wherein first corner-reinforcement unit includes a rigidifier configured to provide means separate from the blow-molded first platform for rigidifying the first outer corner of the blow-molded first platform, the rigidifier includes a perimeter band and a series of stiffener beams coupled to inwardly facing surfaces of the perimeter band to extend across an interior region of the rigidifier bounded by the perimeter band, the tabletop further includes a frame coupled to the underside of the blow-molded first platform, and the first corner-reinforcement unit further includes a frame mount coupled to the perimeter band and configured to mate with the frame to locate the frame alongside the rigidifier.

24. The table of claim 19, wherein the first corner-reinforcement unit includes a rigidifier separate from the blow-molded first platform and coupled to the first corner of the blow-molded first platform, the tabletop further includes a frame coupled to the underside of the blow-molded first platform, the frame includes a first elbow potion arranged to extend into the first interior unit-receiving socket, the first outer corner of the blow-molded platform includes an exterior rim, and the rigidifier is arranged to lie between the first elbow portion and the exterior rim.

* * * * *